US005851443A

United States Patent [19]

Rajendren

[11] Patent Number: 5,851,443

[45] Date of Patent: Dec. 22, 1998

[54] AERATOR WITH DUAL PATH DISCHARGE

[76] Inventor: Richard B. Rajendren, 1013 Park La., Bell Plaine, Minn. 56011

[21] Appl. No.: 760,925

[22] Filed: Dec. 6, 1996

[51] Int. Cl.[6] ..... B01F 3/04

[52] U.S. Cl. ..... 261/87; 261/93

[58] Field of Search ..... 261/87, 93

[56] References Cited

U.S. PATENT DOCUMENTS

| | | | |
|---|---|---|---|
| 616,997 | 1/1899 | Whitney . | |
| 1,374,446 | 4/1921 | Greenawalt . | |
| 1,445,935 | 11/1923 | Daman et al. . | |
| 2,628,827 | 2/1953 | Daman | 261/87 |
| 2,750,328 | 6/1956 | Stimpson et al. | 261/93 |
| 2,928,661 | 3/1960 | MacLaren | 261/24 |
| 3,092,678 | 6/1963 | Braun | 261/30 |
| 3,327,851 | 6/1967 | Anderson | 209/169 |
| 3,606,273 | 9/1971 | Johnson | 259/95 |
| 3,775,307 | 11/1973 | McWhirter et al. | 210/14 |
| 3,778,233 | 12/1973 | Blough et al. | 23/259.1 |
| 3,779,531 | 12/1973 | White | 261/93 |
| 3,969,446 | 7/1976 | Franklin, Jr. | 261/87 |
| 4,240,990 | 12/1980 | Inhofer et al. | 261/87 |
| 4,280,911 | 7/1981 | Durda et al. | 210/629 |
| 4,308,221 | 12/1981 | Durda | 261/87 |
| 4,741,870 | 5/1988 | Gross | 261/93 |
| 4,844,843 | 7/1989 | Rajendren | 261/30 |
| 5,011,631 | 4/1991 | Hwang et al. | 261/87 |

FOREIGN PATENT DOCUMENTS

| | | | |
|---|---|---|---|
| 1242159 | 8/1967 | France . | |
| 4-78492 | 3/1992 | Japan | 261/87 |
| 718372 | 3/1980 | U.S.S.R. . | |

*Primary Examiner*—C. Scott Bushey
*Attorney, Agent, or Firm*—Moore & Hansen

[57] ABSTRACT

An aerator for mixing a gas with a liquid has a motor, fan, rotating central shaft, housing enclosing the shaft, and an air flow pathway between the central shaft and the housing. Rotation of the shaft in the air flow path reduces friction in the flow path and increases efficiency. The shaft may be hollow to provide a second air flow path, also with a rotating shaft in the air flow path to reduce friction, increasing air flow volume and efficiency. A non-lubricated material bearing rotatably mounts the central shaft, and has openings to allow increased air flow through the aerator.

3 Claims, 3 Drawing Sheets

12
2
15
43
23
94
43
10
23
16
2
72
3
32
46
44
20
3
22
62
74

AERATOR WITH DUAL PATH DISCHARGE

BACKGROUND OF THE INVENTION

The present invention relates generally to apparatus for aerating fluid bodies, and particularly to improved aeration of fluid bodies, including fresh water in ponds which tend to stagnate, such as fish and shrimp ponds, ponds on golf courses, recreational landscaping ponds, and artificial pools and waste water in sewage treatment reservoirs and settling ponds.

Aeration of waste water has previously been performed by numerous apparatuses designed for such purposes. The benefits and principles of such aeration are discussed in U.S. Pat. No. 4,844,843 which is hereby incorporated by reference. Typically, aerators have used shaft driven propellers and forced air conduits to deliver ambient gas to the location of the propeller. The propeller is positioned below the surface of the fluid body, and the propeller agitates the water at the air outlet from the air conduit to mix the ambient gas with the water. Common goals among aeration apparatus are the introduction of oxygen bubbles in maximum amounts to the water, and agitation of the water at the site of introduction of the oxygen bubbles.

When an ambient gas such as air is forced through a confined pathway, as is done in aerators, frictional forces are encountered when the air moves against a stationary wall or housing. This friction reduces the efficiency of air flow in the air flow pathway resulting in fewer oxygen bubbles in the agitated water. An example of an aerator using air forced through an air pathway along stationary pathway sides is disclosed in U.S. Pat. No. 4,741,870. The aerator disclosed therein encloses a rotating shaft within a stationary inner housing. Air to be injected into the water is forced through an air pathway between the stationary external side of the inner housing and the stationary internal side of an external housing for delivery to a propeller which agitates the water as the air flow is introduced thereto. The inner housing surrounding the rotating shaft restricts air flow within the aerator to the portion of the aerator between the inner housing surrounding the rotating shaft and the outer housing. Frictional forces exerted by the stationary housing walls on the air flowing in the air flow pathway reduces the air flow in the pathway. Bearings which mount the shaft for rotation within the stationary inner housing do not allow air flow therethrough. The chamber between the rotating shaft and the inner wall of the inner housing is sealed at each end and unused for air movement.

Other known aerators include those described in U.S. Pat. Nos. 4,240,990 to Inhofer et al. and 4,844,843 to Rajendren. The Inhofer et al. patent discloses an aerator with a housing surrounding a hollow rotating inner tube having air intake openings above the water surface and an air outlet below the water surface. The rotating inner tube draws air in through the air intake openings. Air is moved through the inner tube to the air outlet near a propeller. No air flow is disclosed except within that inner tube. The portion of the housing external to the rotating tube is unused for air delivery. The Rajendren aerator uses a pair of opposing compression blades to compress air which is drawn through inlet slots into a rotating central, hollow propeller shaft and injects the compressed air into the waste water through an opening adjacent to the propeller. No air flow outside of the hollow shaft is disclosed.

Other aerators which rely solely upon a venturi or vacuum principle to draw air into a rotating hollow tube to transport the air to below the water surface are disclosed in U.S. Pat. Nos. 4,240,990, 4,280,911, and 4,308,221. Each of these aerators contains a single air flow path, which limits the amount of air flow through the aerators.

It would be desirable to provide an aerator with less frictional resistance to air flow.

It would also be desirable to provide an aerator with an increased volume of air flow.

Presently, bearings are used to support the solid or hollow rotating propeller shaft to journal the shaft for rotation in the aerator. Such bearings are either water bearings, or the bearings must be enclosed or sealed so as to prevent water from reaching the bearing parts, and lubricated to prevent bearing wear. Such sealed bearings do not allow air flow therethrough, and since the bearings are also used as support for the shaft, they thus limit the air flow through the housing of an aerator. It would be desirable to provide an aerator having a bearing which will allow air flow therethrough, but which is not subject to the frailties of a sealed bearing.

BRIEF SUMMARY OF THE INVENTION

The present invention overcomes the limitations of the prior art by providing an aerator having an air pathway immediately adjacent the outside of a rotating shaft to increase air flow and improve flow characteristics through the pathway and aerator. Additionally, a second air pathway may be provided within the hollow rotating shaft to further increase air flow.

An aerator embodying the present invention has a rotating central shaft which may be solid or hollow. A housing encloses the central shaft, and the shaft and the housing define an air flow pathway therebetween. A non-lubricated material bearing has a bearing aperture through which the shaft may be slid so as to position the bearing near the air outlet from the bottom of the aerator, which in operation will be below the surface of the body of water being aerated. The bearing contains air flow openings which allow the passage of air through the bearing. A suitable fan and motor provide air flow for the aerator and rotation of the shaft. A propeller is attached at the lower end of the shaft.

Air flow in the air flow pathway between the central shaft and the housing is aided by the rotation of the central shaft. When the central shaft rotates, the air flow in the air pathway between the central shaft and the outer housing will be improved due to the reduced friction of the air moving against the rotating shaft. The openings in the non-lubricated material bearing also allow increased air flow in the air flow pathway between the central shaft and the outer housing.

The propeller is slid onto the shaft and secured there by a diffuser structure threaded onto the threaded end of the shaft. A half moon key fits into slots in the propeller and the shaft and allows the propeller to be held without rotating separately from the shaft.

An additional air flow pathway may be provided by using a hollow central shaft having air intake openings at its upper end and an air outlet at its lower end adjacent the propeller and below the water surface. The air flow within the central hollow shaft will also be less restricted due to the reduced friction at the interface point of direct contact of the moving air with the rotating inner walls of the central shaft.

The improved air flow due to air flowing immediately adjacent a rotating wall increases the efficiency of the aerator. Additionally, the provision of two air pathways, each having air flow immediately adjacent a rotating wall, utilizes as much of the area contained within the outer housing as possible for air flow pathways, thereby increasing air flow volume through the aerator while also increasing air flow efficiency.

A variety of fan types may be used to direct air into the air flow pathways. The air introduced into the air flow pathways may be compressed or simply blown into the pathways.

These and other objects and benefits of the present invention will become apparent from the following detailed description thereof taken in conjunction with the accompanying drawings, wherein like reference numerals designate like elements throughout the several views.

DESCRIPTION OF THE PREFERRED EMBODIMENT

Figure 1:
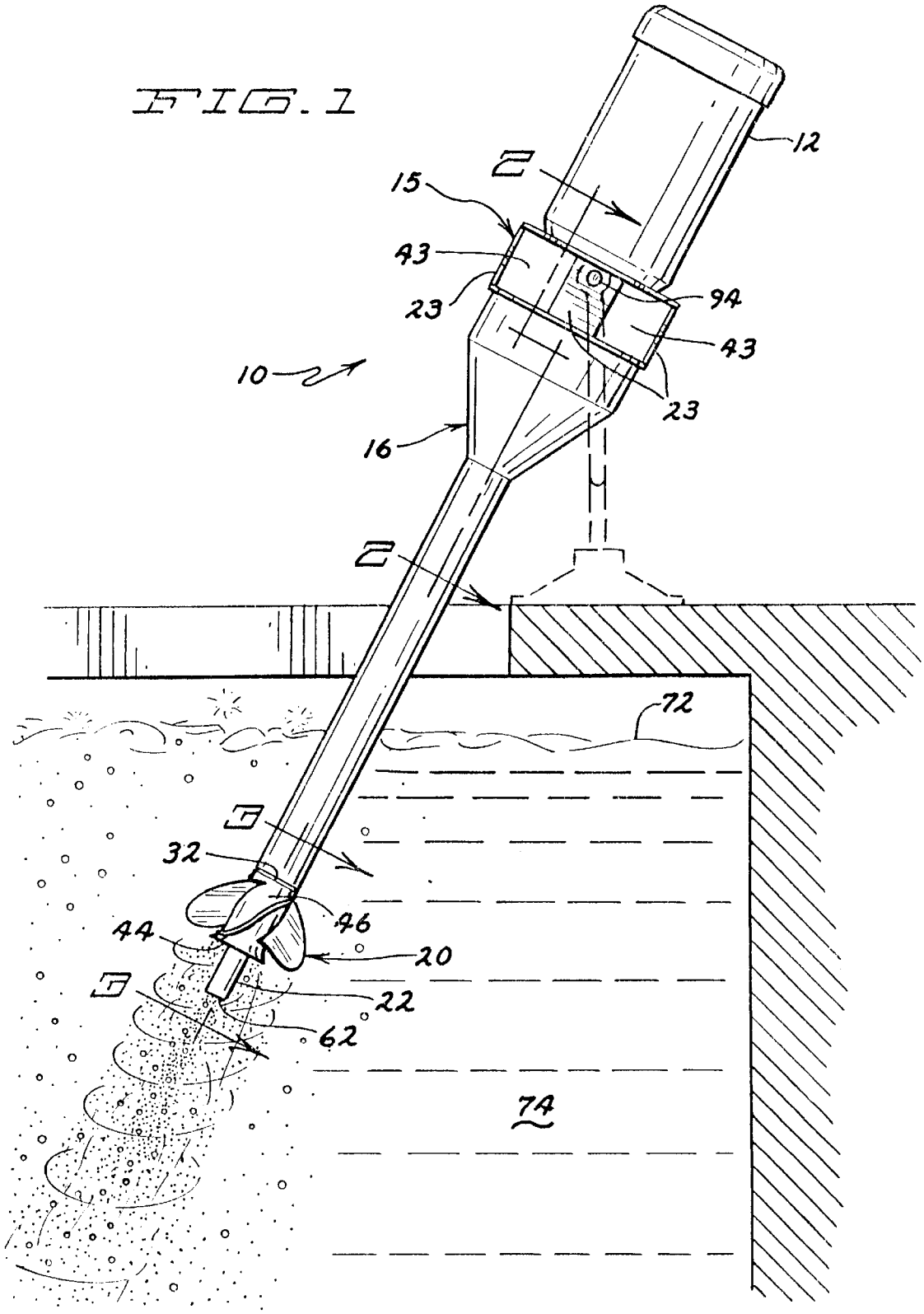
FIG. 1 is a perspective view of an embodiment of the present invention.
Figure 2:
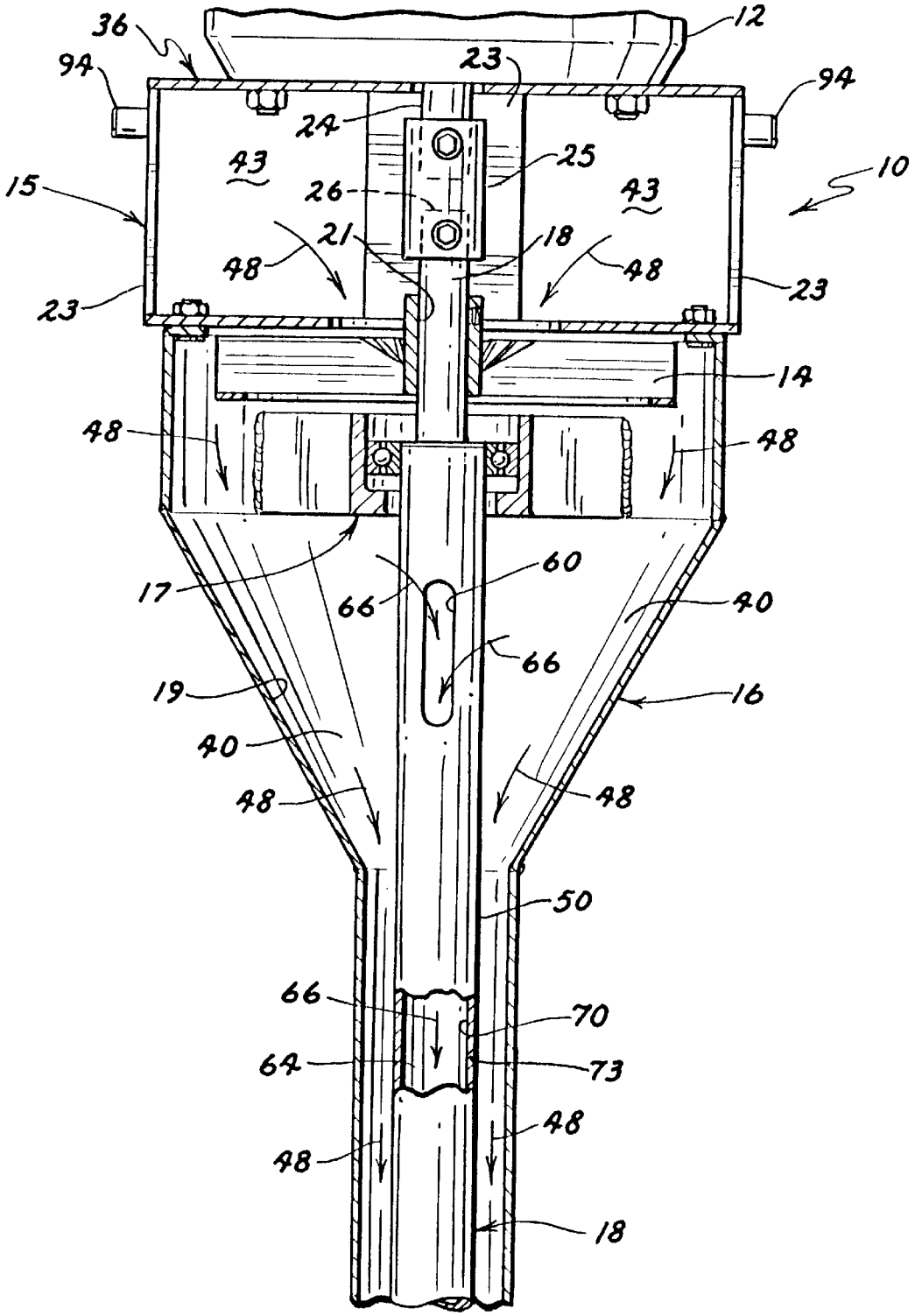
FIG. 2 is a section view of the embodiment of FIG. 1 taken along lines 2—2 thereof.
Figure 3:
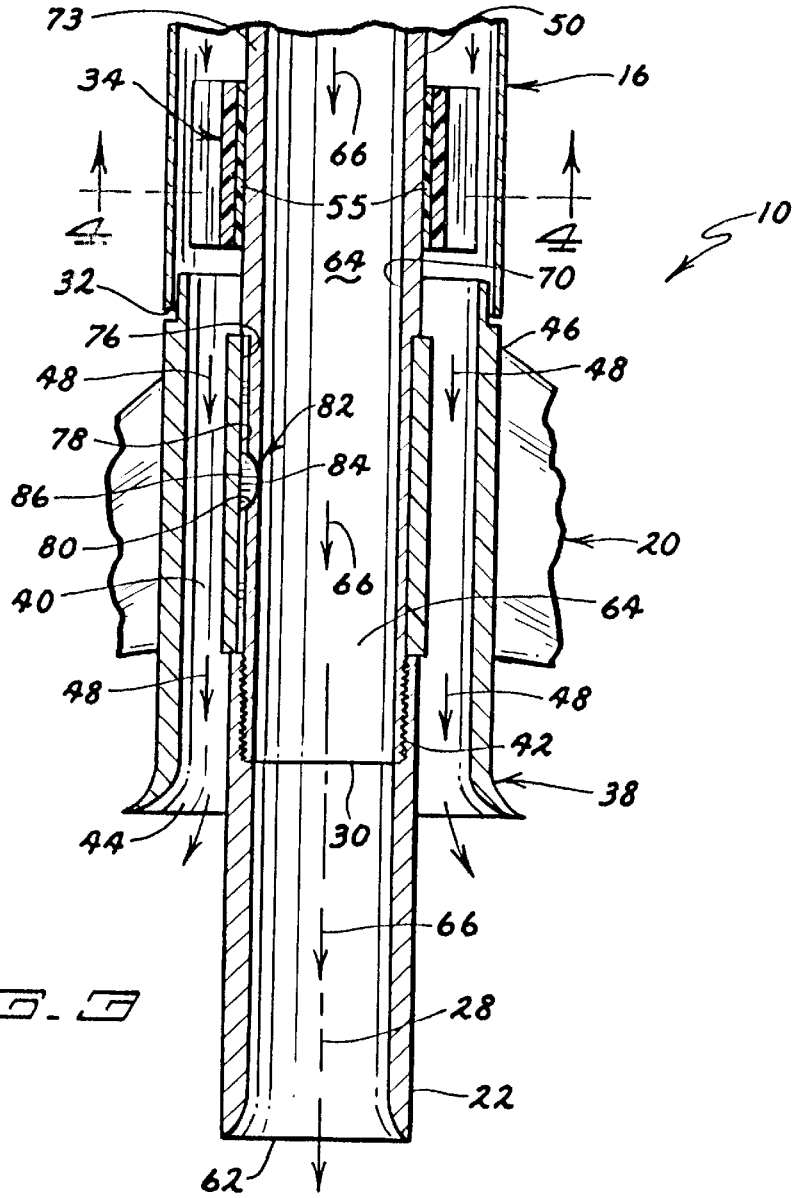
FIG. 3 is a section view of the embodiment of FIG. 1 taken along lines 3—3 thereof.

Referring to FIGS. 1–3, the aerator 10 is seen to include motor 12, blower means 14, outer housing 16, central shaft 18, propeller 20, and diffuser means 22. Motor 12 has a motor shaft 24 to which central shaft 18 is joined by coupling 25 at its upper end 26, so that motor 12 may rotate central shaft 18 about longitudinal axis 28. A conventional upper bearing 17 mounts shaft 18 for rotation. Lower end 30 of central shaft 18 is provided with threads 42. Propeller 20 has central shaft mounting aperture 21 which allows propeller 20 to be slid onto central shaft 18 at its lower end 30. Propeller housing 46 of propeller 20 abuts shoulder 32 of outer housing 16. A diffuser 22 is threaded onto threads 42 at lower end 30 of central shaft 18 to retain propeller 20 on central shaft 18. Lower bearing 34 carried by outer housing 16 rotatably mounts central shaft 18 within outer housing 16.

Outer housing 16 and rotating central shaft 18 define a first air flow pathway 40 therebetween. First air flow pathway 40 has air intake openings 43 near the blower means 14, and air outlet 44 situated between diffuser 22 and housing 46 of propeller 20 at a position which will be below the surface 72 of water 74 in normal operation. Air intake openings or ports 43 are spaced apart around ported shroud 15. Ported shroud 15 has a plurality of mount plates 23, also spaced apart around its circumference. Ported shroud 15 is attached to motor 12 and outer housing 16 in any known manner, such as by nuts and bolts. Air ports or intake openings 43 may also be used to access components of aerator 10 such as coupling 25 and the bolts attaching ported shroud 15 to motor 12 and outer housing 16. Air flows in first air flow pathway 40 from upper end 36 of aerator 10 in the direction shown by arrows 48, and is discharged from aerator 10 through air outlet 44. The interface 50 formed at hollow shaft 18 between air flowing in first air flow pathway 40 and air within the rotating central shaft 18 reduces the frictional forces encountered by the moving air. A stationary interface would create higher frictional forces for the air at the interface. The rotating interface 50 increases the efficiency of air flow in air flow pathway 40, increasing the efficiency of aerator 10.

Figure 4:
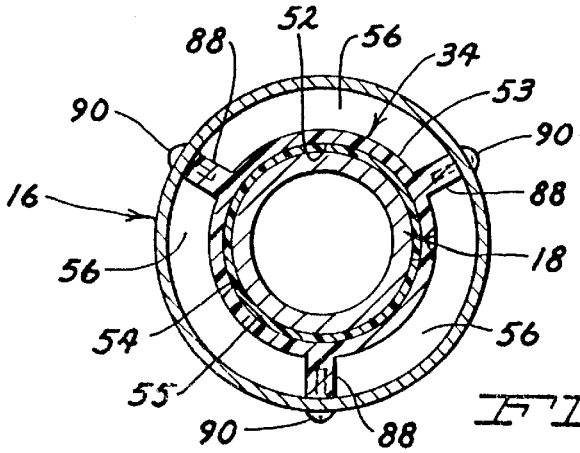
FIG. 4 is a section view of the bearing and aerator taken along lines 4—4 of FIG. 3.

Referring now to FIG. 4, the lower bearing 34 is preferably formed of a low friction material which requires no lubrication. Bearing 34 is cylindrical in shape, and has bearing aperture 52 in central ring 53 sized to rotatably accommodate central shaft 18 therein. Bearing 34 is attached to outer housing 16 in any known way and is positioned between outer housing 16 and central shaft 18 to allow central shaft 18 to rotate against bearing surface 54 of bearing 34. Air flow openings 56 are located between the central ring 53 of bearing 34 and outer housing 16. The air flow openings 56 are aligned parallel to longitudinal axis 28. Air flow openings 56 allow air to freely flow through first air flow pathway 40 to outlet 44 without substantial impediment by bearing 34. A low friction sleeve 55 may be positioned in aperture 52 between central ring 53 and central shaft 18 to further increase efficiency of bearing 34.

Bearing 34 does not require lubrication or sealing even though it may be positioned under the surface 72 of body of water 74 during operation of aerator 10. Bearing 34 is preferably machined from plastic stock such as UHMW stock. Bearing 34 is attached to outer housing 16 by suitable screws or bolts 90, which pass through the housing 16 and are threaded into solid spokes 88 which extend between central ring 53 and the inner surface 19 of outer housing 16. Other suitable means for attaching the bearing 34 to housing 16 may also be employed, and are within the scope of the invention. The arrangement of spokes 88 is preferably one of equal spacing around the central ring 53 so that each air flow opening 56 is of equal size. In this arrangement, spokes 88 can provide maximum support between central ring 53 and outer housing 16. The use of non-lubricated bearing 34 allows central shaft 18 to be rotatable within outer housing 16 yet still be supported against vibration and distortion, as well as providing the benefit of allowing air flow in air flow pathway 40 against a rotating wall to reduce frictional forces along in the air flow pathway. No stationary support tube is necessary for the shaft 18 when using the bearing 34 of the present invention. The specific bearing 34 shown in illustrative of a suitable bearing for aerator 10. However, other low maintenance bearings may be substituted without departing from the scope of the invention.

Central shaft 18 is preferably hollow, having a plurality of air intake openings 60 downstream from blower means 14. An air outlet 62 is positioned adjacent diffuser means 22 at lower end 38 of aerator 10 which will be below the surface 72 of water 74 in normal operation of aerator 10. Aerator 10 has a second air flow pathway 64 within rotating central shaft 18, through which air may flow in the direction indicated by arrows 66. As central shaft 18 rotates about longitudinal axis 28, air blown by blower means 14 not only flows in first air flow pathway 40 but also enters intake openings 60 and flows along second air pathway 64 to air outlet 62. The interface 50 between inner wall 70 of shaft 18 and air flowing in the second air flow pathway 64 also reduces frictional forces in comparison to an interface between air flow and a stationary wall. The air flow indicated by arrows 66 will be subject to less resistance than air flow against stationary side walls.

The combination of first and second air flow pathways 40 and 64 increases the total flow of air through aerator 10 by utilizing more volumetric flow area than other aerators. Further, the two air flow pathways 40 and 64 have between them a common rotating interface 50, which is the wall 73 of central shaft 18. The flow characteristics of air flowing against a moving surface allow the air in each air flow pathway 40 and 64 to flow more freely. In this manner, aerator 10 provides not only increased total flow of air through aerator 10, but also allows air to flow more efficiently therethrough.

Referring now to FIGS. 1 and 2, propeller 20 may be seen to slidably fit onto lower end 30 of central shaft 18. Propeller housing 46 of propeller 20 abuts shoulder 32 of outer housing 16, and diffuser 22 is screwed onto threads 42 on lower end 30 of central shaft 18. Propeller housing 46 has a longitudinal axis coincident with longitudinal axis 28 of central shaft 18. A slot 76 is positioned longitudinally along the inside surface 78 of propeller housing 46. A hemispheric slot 80 is cut into central shaft 18 in the area of central shaft 18 over which propeller 20 slides. A hemispheric key 82 is placed with its rounded side 84 into the hemispheric slot 80. The propeller 20 is then slid onto central shaft 18 with its longitudinal slot 76 aligned with the flat side 90 of hemispheric key 82. Once propeller 20 is secured against sliding off central shaft 18 by diffuser 22, propeller 20 will also be secured against rotational slippage with respect to central shaft 18. When central shaft 18 rotates, propeller 20 will rotate therewith.

Blower means 14 is employed with motor 12 to produce ambient gas flow for air flow pathways 40 and 64. Motor 12 is preferably an electric motor, although motors powered by alternative power would also be acceptable. For the applications of the present invention, however, an electric motor is preferred. The blower means 14 and motor 12 are situated within outer housing 16 near upper end 36 of aerator 10. Blower means 14 is preferably a fan, which may be chosen from a number of suitable fans including a squirrel cage fan or a series of different types of radial propeller blades. It should be understood that a wide variety of fans are suitable for use with aerator 10, and the function of blower means is simply to provide air flow for the air flow pathways of the aerator 10.

Aerator 10 may be mounted by trunnions 94 to a suitable frame or mounting structure as is shown in FIG. 1. Additionally, aerator 10 may be mounted to any suitable mounting structure such as a pair of floats for free floating motion through water body 74 and the like.

In operation, aerator 10 functions as follows. Motor 12 is started and is used to rotate central shaft 18 and blower means 14 around longitudinal axis 28. Air is moved by blower means 14 into air flow pathway 40 between central shaft 18 and outer housing 16 and is discharged through air outlet 44 below the surface 72 of water body 74. Central shaft 18 may be solid or hollow. If hollow, second air flow pathway 64 may also be used for air flow within the hollow central shaft 18 as is shown in FIGS. 2 and 3. Air intake openings 60 allow air to enter the second air flow pathway 64 within central shaft 18. Air is expelled from pathway 64 at air outlet 62 below surface 72 of water body 74. The two air pathways have between them a common rotating wall 73. Since air is flowing along rotating wall 73, frictional forces which are ordinarily present when air flows against a stationary surface are greatly reduced, allowing increased air flow efficiency to aerator 10. Further, the use of two air flow pathways increases the volume of air flow through the aerator 10. The improvement in air flow through aerator 10 is as much as 25–30% over prior art aerators.

The detailed description outlined above is considered to be illustrative only of the principles of the invention. Numerous changes and modifications will occur to those skilled in the art, and there is no intension to restrict the scope of the invention to the detailed description. The preferred embodiments of the invention having been described in detail the scope of the invention should be defined by the following claims.

What is claimed is:

1. An aerator for mixing an ambient gas with a liquid, comprising:

a motor having a shaft;

blower means operatively connected to said motor;

a central shaft coupled to said motor shaft whereby when said motor is operating said central shaft rotates;

an aerator housing enclosing said central shaft and communicating with said blower means, said housing and said rotating central shaft defining a first air flow pathway therebetween, said air flow pathway having an air intake and an air outlet and said rotatable central shaft reducing friction between said shaft and air moving therealong;

a propeller means connected to said central shaft to rotate therewith for mixing the ambient gas with the liquid adjacent said air outlet;

a bearing having a bearing aperture, said central shaft rotatably mounted in said bearing aperture, and said bearing attached to said housing;

said bearing further comprising a plastic body having a central ring with said bearing aperture centrally located therein and a plurality of support spokes extending outward from said ring and positioned to engage said housing; and said ring, said spokes and said housing defining a plurality of spaced apart air flow openings therebetween, said air flow openings allowing the free flow of air through said bearing.

2. An aerator for mixing an ambient gas with a liquid, comprising:

a motor having a shaft;

blower means operatively connected to said motor;

a central shaft coupled to said motor shaft whereby when said motor is operating said central shaft rotates;

an aerator housing enclosing said central shaft and communicating with said blower means, said housing and said rotating central shaft defining a first air flow pathway therebetween, said air flow pathway having an air intake and an air outlet and said rotatable central shaft reducing friction between said shaft and air moving therealong;

a propeller means connected to said central shaft to rotate therewith for mixing the ambient gas with the liquid adjacent said air outlet;

a bearing have a bearing aperture, said central shaft rotatably mounted in said bearing aperture, and said bearing attached to said housing; and wherein said central shaft is hollow and has a top and a bottom, said central shaft having an air intake opening near said top and communicating with said blower means and an air outlet opening near said bottom, said hollow central shaft defining a second air flow pathway, whereby air flows from said air intake opening to said air outlet, and air flow is increased within said aerator by reason of said hollow shaft rotating during operation to reduce friction between said shaft and air flowing along said second pathway.

3. In an aerator of the type used for mixing an ambient gas with a liquid having a surface, said aerator having an aerator housing, a blower means, a central shaft mounted for rotation about a longitudinal axis of rotation within said housing, and a propeller means connected to said shaft, said aerator being mountable such that air is discharged adjacent said propeller means below the surface of the liquid, the improvement comprising:

first and second air flow pathways communicating with said blower means, said first flow pathway within said hollow central shaft, said housing and said central shaft defining said second air flow pathway therebetween, whereby said first and said second air flow pathways have a common rotating wall of said central shaft therebetween to increase flow efficiency of the air through said first and said second air flow pathways; and a bearing having a bearing aperture, said central shaft extending through said aperture, and said bearing allowing rotation of said central shaft within said aperture, said bearing attached to said housing and providing support between said central shaft and said housing.

* * * * *